US008082668B2

(12) United States Patent
Samson

(10) Patent No.: US 8,082,668 B2
(45) Date of Patent: Dec. 27, 2011

(54) NAIL CLIPPER

(76) Inventor: Ilan Zadik Samson, London (GB)

( * ) Notice: Subject to any disclaimer, the term of this patent is extended or adjusted under 35 U.S.C. 154(b) by 965 days.

(21) Appl. No.: 12/043,252

(22) Filed: Mar. 6, 2008

(65) Prior Publication Data

US 2008/0148572 A1 Jun. 26, 2008

(30) Foreign Application Priority Data

Sep. 15, 2006 (GB) ..... 0618145.7

(51) Int. Cl.
*A45D 29/02* (2006.01)

(52) U.S. Cl. ..... 30/28; 30/26; 30/175; 132/75.5

(58) Field of Classification Search ..... 30/26–29, 30/175; D28/60; D30/158; D8/58; 7/162; 132/73–76.5; 119/600–633
See application file for complete search history.

(56) References Cited

U.S. PATENT DOCUMENTS 2,616,436 A * 11/1952 Langley ..... 132/75.5
2,753,626 A * 7/1956 Bowers ..... 30/28
3,903,596 A * 9/1975 Crosby ..... 30/29
4,176,449 A * 12/1979 Lee et al. ..... 30/28
4,341,015 A * 7/1982 Young ..... 30/28
4,847,994 A * 7/1989 Dunn, Jr. ..... 30/28
4,956,915 A 9/1990 Anderson
D361,865 S * 8/1995 Tosolt ..... D28/60
5,459,926 A * 10/1995 Perea ..... 30/28
5,522,136 A * 6/1996 Larisey ..... 30/28
5,546,658 A 8/1996 MacLeod et al.
5,622,191 A 4/1997 McMullen, Jr. et al.
2009/0223055 A1 * 9/2009 Wendorf et al. ..... 30/28

FOREIGN PATENT DOCUMENTS

JP 2003070529 3/2003

* cited by examiner

*Primary Examiner* — Laura M. Lee
(74) *Attorney, Agent, or Firm* — Chernoff, Vilhauer, McClung & Stenzel

(57) ABSTRACT

A nail clipper is described which can be used by a person having only one hand. The nail clipper comprises a base 32 shaped to rest on a horizontal surface and an elongate actuator 30 pivotably connected at one end to the base 32. A first cutting edge is located on the base 32 and an opening 34 is provided in the actuator 30 to allow the nail of a finger of a hand pressing down on the actuator to be placed over the first cutting edge. A second cutting edge movable with the actuator 30 towards the first cutting edge is used to trim the nail resting on the first cutting blade when the actuator 30 is depressed.

5 Claims, 1 Drawing Sheet

NAIL CLIPPER

FIELD OF THE INVENTION

The present invention relates to a nail clipper which can be used to trim the nail of a finger or a toe.

BACKGROUND OF THE INVENTION

One type of nail clipper in common use is of tweezers-like construction. The nail clipper comprises two sprung blades that are pivoted to one another at one end and have two sharp parallel cutting edges at their opposite end which will trim a nail placed between them when the blades are squeezed together. The present invention is concerned with a nail clipper of such a construction as opposed to the other common type of nail clipper which resembles pliers or wire cutters.

Because considerable force is needed to trim a nail, nail clippers are fitted with a lever arm to help squeeze their cutting edges together. The lever arm is pivoted on a pin that passes through the holes near the cutting end of the two blades and as the free end of the lever arm is moved towards the riveted end of the two blades, a projection on the lever arm forces the two blades together.

A disadvantage of such nail clippers is that they are difficult to use by people who are infirm or physically disabled. Even with the assistance of a lever arm, a person suffering from arthritis can often not apply sufficient force with one hand, in particular the left hand, to trim the nails of the other hand. It is also impossible for a disabled person who has lost one hand to use such a nail clipper to trim the nails of the single remaining hand.

There is already known a table mount which can be used as an accessory for a conventional nail clipper. The mount is designed to rest on a horizontal surface and to hold the clipper steady with its lever arm projecting upwards. While so supported, a user can place a nail of one hand between the two cutting edges and press down on the lever arm to trim the nail. This makes it possible for a nail clipper to be used by a person suffering from arthritis or someone who has lost the use of one hand or the fingers of one hand, but still has two arms. It does not however solve the problem for a person who has totally lost the use of one arm.

SUMMARY OF THE INVENTION

According the present invention in its broadest aspect, the invention provides a nail clipper designed to trim a nail on a hand or foot being used to operate it.

The broadest aspect of the invention is predicated on the realisation that one does not need to resort to a clipper that is self-powered or one that is operated by some other part of the body such as the forehead or the chin. Instead, by suitable rethinking of the geometry of the nail clipper, one can use the same hand or foot on which a nail is to trimmed to apply the force needed to trim the nail.

According to a second aspect of the invention, there is provided a nail clipper comprising a base shaped to rest on a horizontal surface and an elongate actuator pivotably connected at one end to the base, a first cutting edge located on the base, an opening in the actuator to allow the nail of finger or toe to be placed over the first cutting edge and a second cutting edge movable by the actuator towards the first cutting edge to trim the nail resting on the first cutting edge when the actuator is depressed.

The second aspect of the invention is predicated on the realization that as pressure must be applied to an upper surface of an actuator to effect a cut while a lower surface of the actuator must be used to move the second cutting edge, it is inevitable that the actuator will itself prevent a nail of the hand or foot pressing down on the actuator from being placed between the two cutting edges. The invention circumvents this problem by allowing the nail to be trimmed or the cutting edges of the clipper to pass through the aperture formed for this purpose in the actuator.

It is desirable for a finger or toe not to have to adopt an uncomfortable position while its nail is being trimmed. In order to achieve this, it is preferred for the actuator to have a generally flat upper surface on which a hand or foot may rest and to provide a bridge which projects above the plane of the upper surface adjacent the opening and overlies the second cutting edge. In this way, the upper of the two cutting edges can be located above the plane on which the hand or foot is placed while a nail is being trimmed.

With the same objective of comfort in mind, it is further preferred for the base to have a generally flat upper surface and an upwardly projecting rest platform for the tip of a finger or toe aligned with the opening in the actuator. This allows the lower of the two cutting edges to be located immediately below a nail, while a hand or foot is resting in a natural position on the upper surface of the actuator.

It would be possible for each of the cutting edges to be separately secured to a respective one of the base and the actuator. However, it is preferred for the cutting edges to be formed on the ends of two sprung blades that are riveted to one another, the two blades being removably retained between the base and the actuator. The latter embodiment allows the blades of a conventional nail clipper to be used after removal of the lever arm and the pin on which the lever arm is pivoted.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
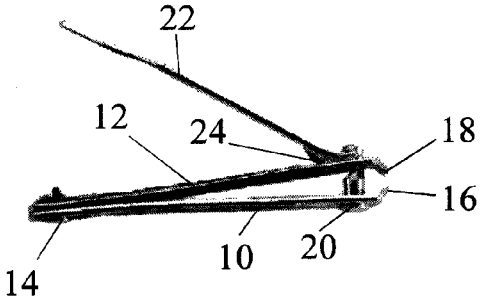
Fig. 1 PRIOR ART
FIG. 1 shows a side view of a conventional nail clipper.

The nail clipper shown in FIG. 1 is conventional and comprises a pair of sprung blades 10, 12 riveted to one another at one end 14 and having accurately machined and aligned cutting edges 16 and 18 at their opposite ends. A pin 20 passing through a hole near the cutting edges 16 and 18 acts as a pivot for a lever arm 22 having a projection 24 which acts to squeeze the two cutting edges 16 and 18 together as the lever 22 is pivoted counter clockwise as viewed. A disadvantage of such a nail clipper, which the invention seeks to overcome, is that it cannot be used by a disabled person who has lost one arm to trim the nails of the single remaining hand.

Figure 2:
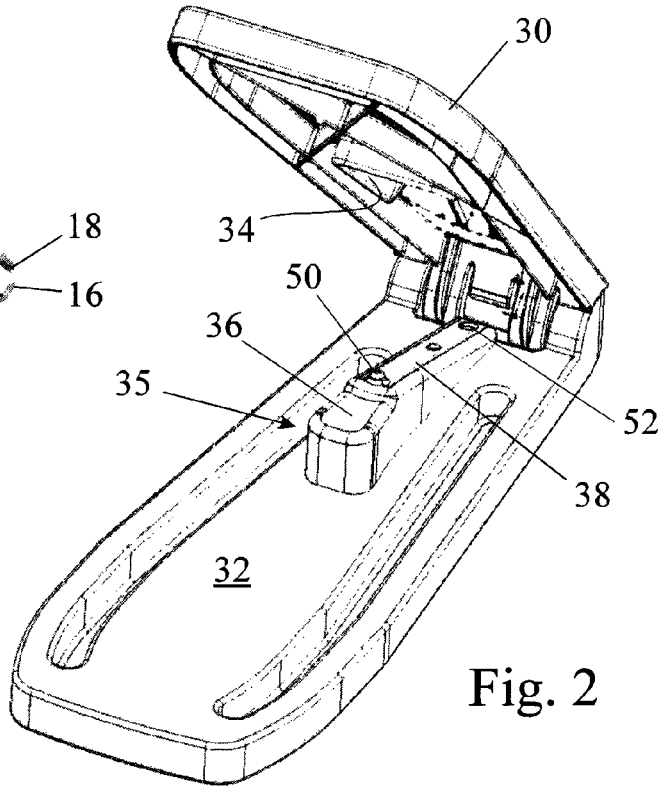
FIG. 2 shows a front perspective of a nail clipper of the invention in a raised position of the actuator.
Figure 3:
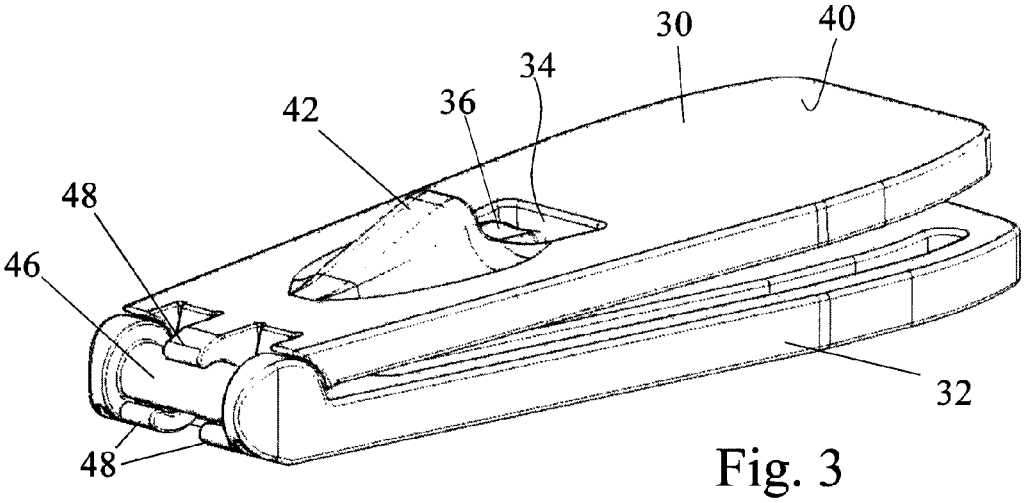
FIG. 3 is a perspective view of the nail clipper of FIG. 2 from the rear and one side in a position in which it is ready for use.

The nail clipper shown in FIGS. 2 and 3 is designed to make use of the cutting blades 10 and 12 only of the nail clipper shown in FIG. 1 after removal of the pin 20 and the lever arm 22. The parts of the nail clipper shown in FIGS. 2 and 3 act as a replacement for the lever arm 22 and make it easier for a disabled or infirm person to use the nail clipper.

The nail clipper of FIGS. 2 and 3 has a base 32 designed to rest on a horizontal surface. An elongate actuator 30 has at one end curved prongs 48 which engage a pin 46 formed on the base 32 to act as a hinge. This allows the actuator 30 to pivot between an open position, such as shown in FIG. 2, and a closed position in which the base 32 and the actuator 30 come together and nearly touch.

The actuator 30 has a generally flat upper surface 40 on which the palm of a hand or the sole of a foot can be placed and an opening 34 through which the tip of a finger or toe can pass to rest on the upper surface of the base 32. As can be seen more clearly in FIG. 3, the actuator 30 also has a bridge 42 which projects above the plane of the surface 40.

The base 32 has a projecting formation 35 which defines a rest platform 36 for the tip of a finger or toe and a ramp 38 for receiving and retaining the blades 10 and 12 of a conventional nail clipper, such as that shown in FIG. 1. To locate and retain the two blades, the ramp 38 has a hole 52 for locating the rivet 14 and a small projecting nipple 50 that locates in the hole for the pin 20. The top surface of the upper blade is engaged by the underside of the bridge 42 so that the cutting edges 16 and 18 are squeezed together as the actuator 30 is depressed.

In use, with the nail clipper in the position shown in FIG. 3, the palm of a hand or sole of a foot is placed on the surface 40 and the tip of a finger or toe of which the nail is to be trimmed is placed on the rest platform 36 of the base 32, which is accessible through the opening 34 in the actuator 30. After the nail has been correctly positioned between the two cutting edges 16 and 18 of the blades 10 and 12 trapped between the ramp surface 38 and the underside of the bridge 42, downward pressure is applied by the palm of the hand or the sole of the foot to the surface 40 to squeeze the two cutting edges together and trim the nail. The mechanical advantage afforded by the actuator ensures that the nail clipper can be operated using relatively little force. The mechanical advantage is optimised by designing the nail clipper such that the bridge 42 is positioned as near possible to the pivot pin 46.

If the thumb nail is to be trimmed, the user must first make a fist and rest the knuckles rather the palm of the hand on the surface 40. The tip of the thumb can then be placed on the rest platform 36 and trimmed.

While the nail clipper of the invention is particularly suitable for a person who has lost an arm, its ease of use with have more general appeal both to people with less severe infirmity and to able bodied people.

The operate the nail clipper by foot is of great benefit to any person who for any reason has difficulty in bending and reaching down to use a conventional hand operated nail clipper.

The illustrated embodiment is used with a removable pair of blades that are joined to one another. This is preferred because it makes for a less expensive construction. The cutting edges can be honed and accurately aligned before the nail clipper is fully assembled and their alignment is not affected by play in the hinge 46, 48. It is nevertheless alternatively possible to mount cutting edges permanently in the base and actuator in which case separate spring means would bias the actuator into a raised position.

The invention claimed is:

1. A nail clipper comprising a base shaped to rest on a horizontal surface and an elongate actuator pivotably connected at one end to the base, a first cutting edge located on the base, an opening in the actuator to allow the nail of a finger or toe to be placed over the first cutting edge and a second cutting edge movable by the actuator towards the first cutting edge to trim the nail resting on the first cutting edge when the actuator is depressed, wherein the actuator has a generally flat upper surface on which a hand or foot may rest with the hand or foot flat while the nail rests on the first cutting edge and a bridge region projecting above the plane of the upper surface adjacent the opening and overlying the second cutting edge whereby the hand or foot resting on the upper surface of the actuator may apply force to the actuator for urging the second cutting edge towards first cutting edge.

2. A nail clipper as claimed in claim 1, wherein the base has a generally flat upper surface and an upwardly projecting rest platform for the tip of a finger or toe aligned with the opening in the actuator.

3. A nail clipper as claimed in claim 1, wherein the cutting edges are each separately secured to a respective one of the base and the actuator.

4. A nail clipper as claimed in claim 1, wherein the cutting edges are formed on the ends of two sprung blades that are riveted to one another, the two blades being removably retained between the base and the actuator.

5. A nail clipper as claimed in claim 1, wherein the cutting edges are formed on the ends of first and second sprung blades that are secured to one another, the two blades being retained between the base and the actuator, the first blade engages the base, and the second blade is engaged by the bridge region of the actuator when the actuator is depressed.

* * * * *